US005634842A

United States Patent [19]

Becker

[11] Patent Number: 5,634,842

[45] Date of Patent: Jun. 3, 1997

[54] APPARATUS FOR THE PRECISION GRINDING OF CONICAL SEATS FOR CYLINDRICAL NOZZLE WORKPIECES

[75] Inventor: Manfred Becker, Novi, Mich.

[73] Assignee: Ernst Thielenhaus KG, Wuppertal, Germany

[21] Appl. No.: 555,269

[22] Filed: Nov. 8, 1995

[51] Int. Cl.[6] ..... B24B 15/04

[52] U.S. Cl. ..... 451/155; 451/61; 451/381; 451/143; 451/212; 451/242; 451/115

[58] Field of Search ..... 457/61, 115, 140, 457/143, 155, 180, 181, 252, 381, 150, 212, 218, 221, 242, 246

[56] References Cited

U.S. PATENT DOCUMENTS

| | | | |
|---|---|---|---|
| 3,352,067 | 11/1967 | Eastabrook | 451/155 |
| 3,388,232 | 6/1968 | Preisin | 451/115 |
| 4,581,854 | 4/1986 | Collopy | 451/117 |
| 5,022,195 | 6/1991 | Cattelain et al. | 451/61 |
| 5,095,662 | 3/1992 | Grimm et al. | 451/61 |
| 5,315,792 | 5/1994 | Schweizer et al. | 451/115 |

*Primary Examiner*—Willis Little
*Assistant Examiner*—Eileen P. Morgan
*Attorney, Agent, or Firm*—Herbert Dubno

[57] ABSTRACT

An apparatus for the precision grinding of conical valve seats of nozzles, for example, injection nozzles for internal combustion engines. The body is entered hydraulically on a mandrel and a driver has a rubber O-ring braced against the nozzle body to frictionally engage it is rotation while passing through the mandrel for the shaft of a grinding tool which is located at the end of the mandrel. The system avoids radial clamping stresses on the workpiece and hence allows, precision low tolerance finish grinding to be achieved.

18 Claims, 3 Drawing Sheets

FIG. 3
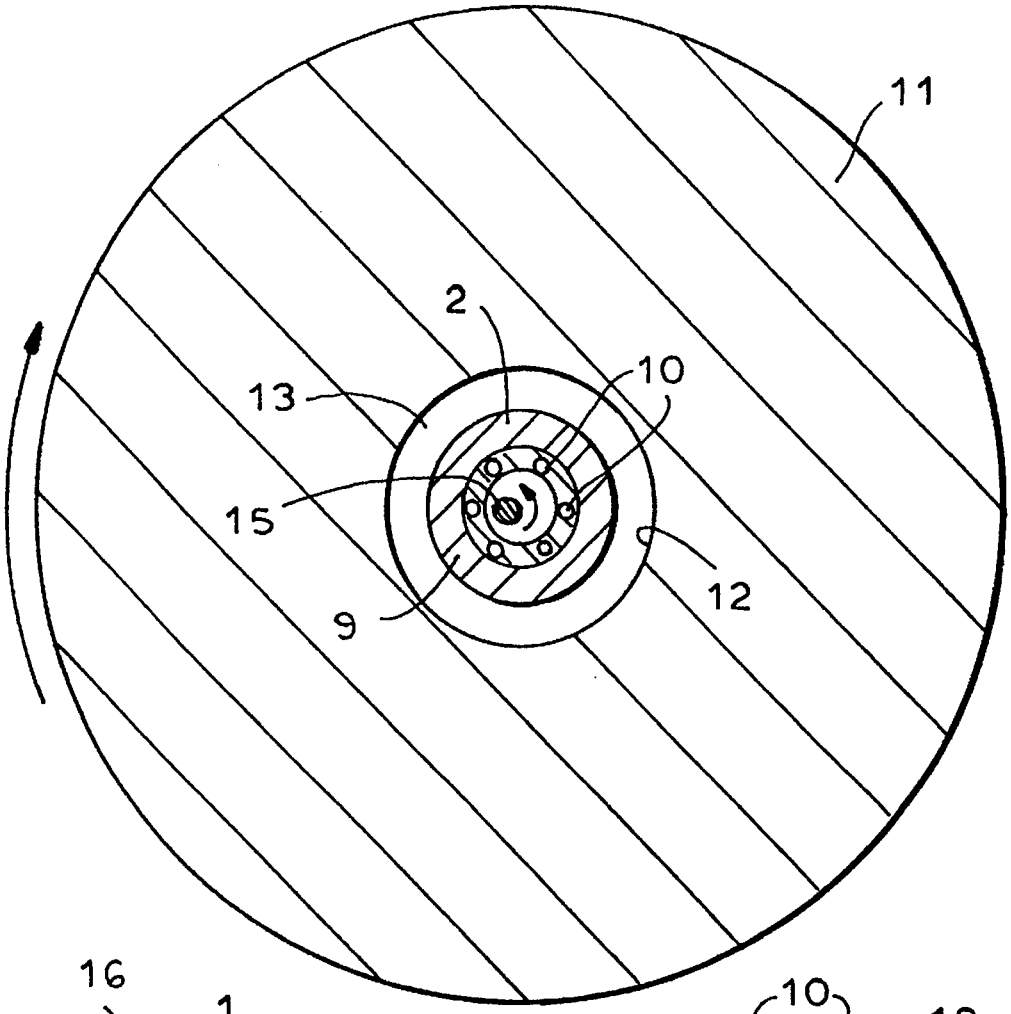
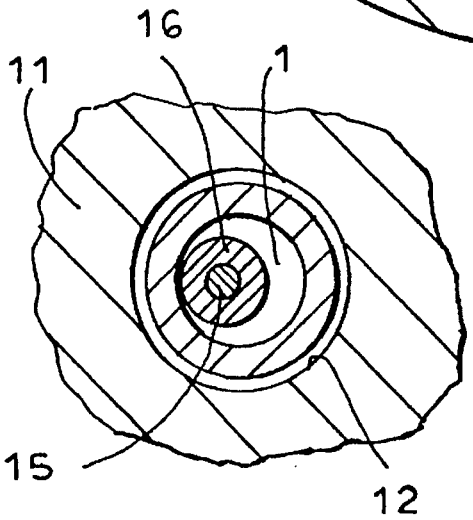
FIG. 4
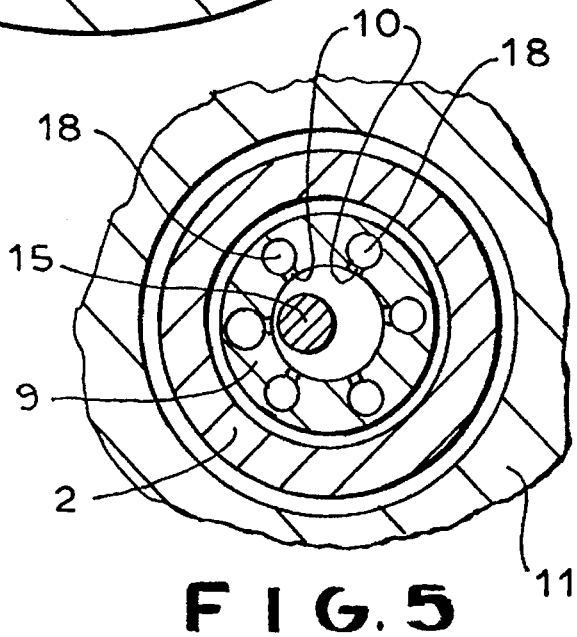
FIG. 5

APPARATUS FOR THE PRECISION GRINDING OF CONICAL SEATS FOR CYLINDRICAL NOZZLE WORKPIECES

FIELD OF THE INVENTION

The present invention relates to an apparatus for the precision grinding or polishing of the internal conical sealing seat of a nozzle, i.e. the seat which may be engaged by a valve member in a nozzle body of the type in which such an internal conical seat is provided between a cylindrical bore and the nozzle orifice at the apex of the cone.

BACKGROUND OF THE INVENTION

Nozzle bodies having an internal conical seat between a cylindrical bore and a nozzle orifice at the apex of that seat and hence along the axis thereof, can be used in a variety of systems. For example, they can be employed as the so-called injection nozzle for internal combustion engines.

Injection nozzles of that type can be provided with valve bodies which themselves are formed from externally conical members on respective spindles and which can sealingly engage the seat. The valve member can have a spherical configuration to engage the seat with line contact.

Regardless of the particular configurations, the valve member and the seat must have a highly exact fit with extremely small tolerances.

Furthermore, they tend to be small as well and must be fabricated with extremely high precision. The nozzle body can extremely have one or more shoulders and/or one or more grooves to allow them to be mounted in place.

In the past, for the precision grinding or polishing of the internal conical seat of the generally cylindrical nozzle, the latter was clamped, e.g. in a chuck, so that, during the grinding or polishing operation, stresses would be applied to the workpiece. The clamping deformation contributed to increased tolerances and, as a consequence, there were difficulties in the precision grinding or polishing of the workpiece. Other techniques required stabilization of the tool and the like to achieve the high precisions and low tolerances which were required.

OBJECTS OF THE INVENTION

It is, therefore the principal object of the present invention to provide an improved apparatus for the precision grinding or polishing of the internal conical sealing seat of such a cylindrical nozzle body whereby high precision and low tolerances can be obtained.

Another object of the invention is to provide an apparatus for the purposes described which can carry out precision grinding or polishing of nozzle workpieces without the stresses introduced by chucks and other measures hitherto required.

SUMMARY OF THE INVENTION

These objects and others which will become apparent hereinafter are attained, in accordance with the invention, in the precision grinding or polishing of the internal conical sealing seat, i.e. the hollow conical seat of a cylindrical nozzle body having a cylindrical bore adjacent this seat and coaxial therewith, and a nozzle orifice at the apex of the seat and also coaxial therewith, it being understood that the hollow conical seat is preground prior to the precision or finish grinding or polishing operation.

The apparatus for this purpose comprises a workpiece slide having a fixed (nonrotatable) hydrocentric receiving mandrel over the length of which outlet openings are provided for a hydrocentric centering medium, i.e. a liquid which is forced between this mandrel and the nozzle body which is fitted over it so as to hydraulically center the workpiece.

Juxtaposed with the mandrel is a driver which is rotated and which has a cylindrical recess receiving the mandrel with the nozzle body mounted thereon. The driver is formed with an elastic entrainer which frictionally engages the workpiece as it is pressed thereagainst but which does not contribute any clamping stress to the workpiece and thus can be considered to be in stress-free engagement with the workpiece. The entrainer frictionally entrains the workpiece around the mandrel by this frictional engagement.

The hydrocentric mandrel is provided centrally with a longitudinally extending receiving bore or passage through which the drive shaft of the precision grinding or polishing tool extends, this tool being located between the end of the mandrel and the internal conical seat and being located by the drive shaft via a motor on the slide which is coupled with the drive shaft.

When hydrocentering is mentioned herein, I intend thereby to refer to the use of a liquid under pressure to center the workpiece on the mandrel so that the hydrocentering is substituted for mechanical radial forces as arise with chucking. Hydrocentering has been used heretofore for the fine grinding and polishing of ball bearing rings and similar workpieces.

The fluid cushion provided by the hydraulic centering enables free rotation of the workpiece and involves hydrodynamic forces as a result. The diameter of the hydrocenter mandrel is smaller than the diameter of the nozzle bore by an amount sufficient to allow that cushion of hydraulic centering medium to form.

While the workpiece and the external surface of the mandrel are concentric to one another, the passage and the mandrel need not be centered on the axis. A hydrocentering can also be used for the shaft in the passage through the mandrel by forcing the hydraulic medium into the latter.

Surprisingly, although the nozzle body is axially extended by comparison with a bearing ring or race, centering for internal precision grinding of the valve seat can be effected utilizing the hydraulic centering forces without stresses to enable a surprisingly high precision to be obtained notwithstanding the fact that the tool is located at the end of a relatively long shaft and the nozzle body itself may be elongated.

The apparatus according to the invention can thus comprise:

- a machine slide;
- a hydrocentric mandrel mounted on the machine slide and upon which the workpiece is positioned and having an outer surface juxtaposed with a wall of the bore, and outlet openings at the outer surface spaced along a length of the mandrel for forcing a centering liquid between the mandrel and the workpiece, the mandrel having a central passage;
- a driver body movable toward the machine slide and formed with a cylindrical recess receiving the workpiece and provided with means for rotating the body about an axis of the recess;
- an elastic entrainer on the body frictionally engageable with the workpiece upon movement of the driver body toward the machine slide for rotatably entraining the workpiece with the body around the axis;

a precision grinding tool located beyond an end of the mandrel engaging the internal conical sealing surface;

a drive shaft connected to the tool and extending through the passage; and a motor on the slide connected to the shaft for driving the tool.

According to a feature of the invention, the mandrel has, distributed about its axis, a multiplicity of distributor bores which run parallel to the axis and which open at axially spaced openings at the outer periphery of the mandrel, if centering of the shaft hydraulically is also desired, into the aforementioned passage. This insures a highly uniform development of the hydraulic cushion.

The hydraulic medium can be hydraulic fluid as is commonly used for operation of hydraulic cylinders and the like or a flushing oil of the type widely used in grinding and polishing operations.

According to a feature of the invention, the tool and the driver are rotated in opposite senses. The elastic entrainer can be a rubber O-ring received in a groove formed in the driver body around the aforementioned recess.

The passage in the mandrel can eccentrically surround the geometric axis thereof and this allows the drive shaft to receive an oscillating move which is superimposed upon the rotation of the tool. This oscillating movement can be in a direction parallel to a generatrix of the valve seat. The amplitude of the superimposed oscillatory movement is small and will be determined by the need to maintain contact of the precision grinding stone with the valve seat. An axial bore can be provided in the fine grinding stone, to insure that the hydraulic centering medium or flushing oil will be certain to reach all portions of the surfaces engaged by the grinding stone.

BRIEF DESCRIPTION OF THE DRAWING

The above and other objects, features, and advantages will become more readily apparent from the following description, reference being made to the accompanying drawing in which:

FIG. 3 is a section taken along the line III—III of FIG. 2;

FIG. 4 is a section taken along the line IV—IV of FIG. 2; and

FIG. 5 is another transverse section but drawn to a larger scale.

SPECIFIC DESCRIPTION

Figure 1:
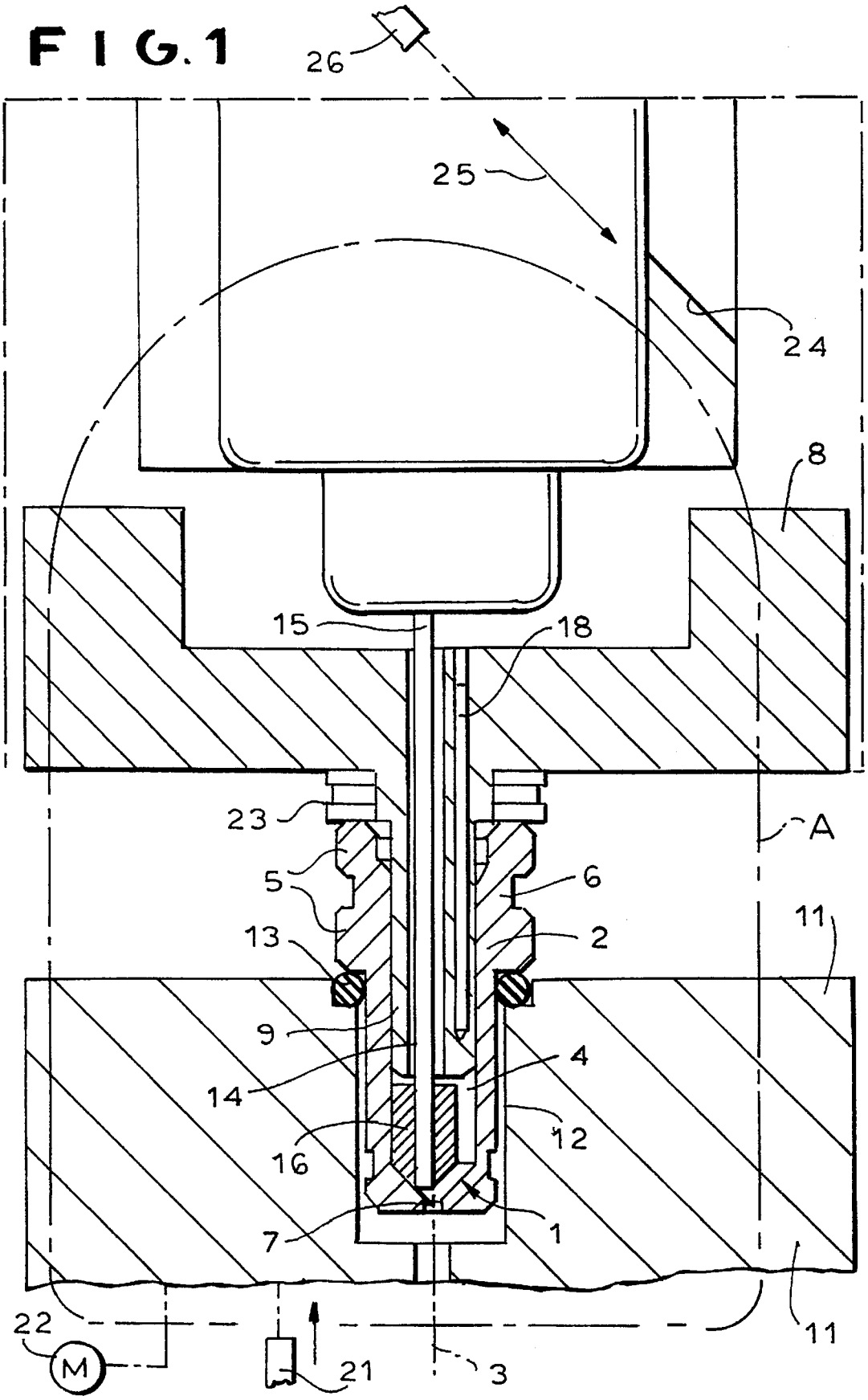
FIG. 1 is an axial section through an apparatus according to the invention.

The apparatus shown in the drawing is intended to precision grind or polish the hollow conical valve seat 1 of a circularly cylindrical nozzle body or workpiece 1 which has a bore 4 which is concentric with the cylindrical axis 3. The apparatus for part of a precision grinding machine which can have the usual magazines or other means for feeding the workpieces to be ground and for removing the ground products.

The nozzle body or workpiece 2 has, along its exterior, one or more shoulders 5 and one or more grooves 6 which serve for mounting the nozzle bodies in place. The seat 1 and bore 4 are concentric with the axis 3 and the bore 4 is adjacent the seat 1. Along the axis at the apex of the seat 1, a nozzle orifice 7 is provided.

To receive the nozzle body 2, a workpiece slide 8 is provided. This slide has a fixed nonrotatable hydrocentric receiving mandrel 9. This hydrocentric member 9 has outlet openings 10 distributed along its length at the outer periphery for delivering a hydraulic centering medium, e.g. slide by a pump 20, to form a hydraulic cushion around the mandrel 9 and between the nozzle body 2.

The hydrocentric mandrel 9 is juxtaposed with a driver 11 in the form of a circularly cylindrical body which can be displaced toward the slide 8 by a hydraulic or other actuator represented at 21 and can be rotated by a motor 22 about the axis 3.

The driver 11 has a cylindrical recess 12 into which the mandrel 9 with the workpiece 2 thereon can fit. The diameter of the mandrel 9 is smaller than the diameter of the bore 4 by twice the radius of the cushion or hydraulic liquid.

The driver 11 has an elastic entrainer 13 in the form of an O-ring, for the frictional engagement of the mandrel 9 without stressing the latter. The stress free engagement is here intended to mean that no radial clamping force is applied to the workpiece and, as a consequence, clamping tolerances do not arise. Any rotational irregularities of the driver 11 are compensated by elastic deformation of the entrainer 13. The workpiece 2 can be pressed against a fluid roller or other bearing 23 of the slide 8.

The hydrocentric mandrel has a central passage 14 through which the drive shaft 15 can extend to the precision grinding tool or wheel 16. The latter can be shaped with a conical portion and a cylindrical portion as shown to correspond to the cylindrical and conical portions of the bore 4 and the seat 1, respectively.

The tool 16 is driven by a motor 17 on the slide 8 and the slide 8 itself can be pneumatically displaced. If desired, the motor 17 can be mounted on a guide 24 so that it can be displaced in the direction of the arrow 25 by a reciprocating effector 26 to superimpose an oscillatory movement on the motor and hence the tool which is parallel to a generatrix of the seat 1.

The mandrel 9 can have a plurality of distributor bores 18 equispaced about its axis (see especially FIG. 5) and these distributor bores 18 can be provided with axially spaced openings 10 delivering the hydraulic fluid to the cushion.

Figure 2:
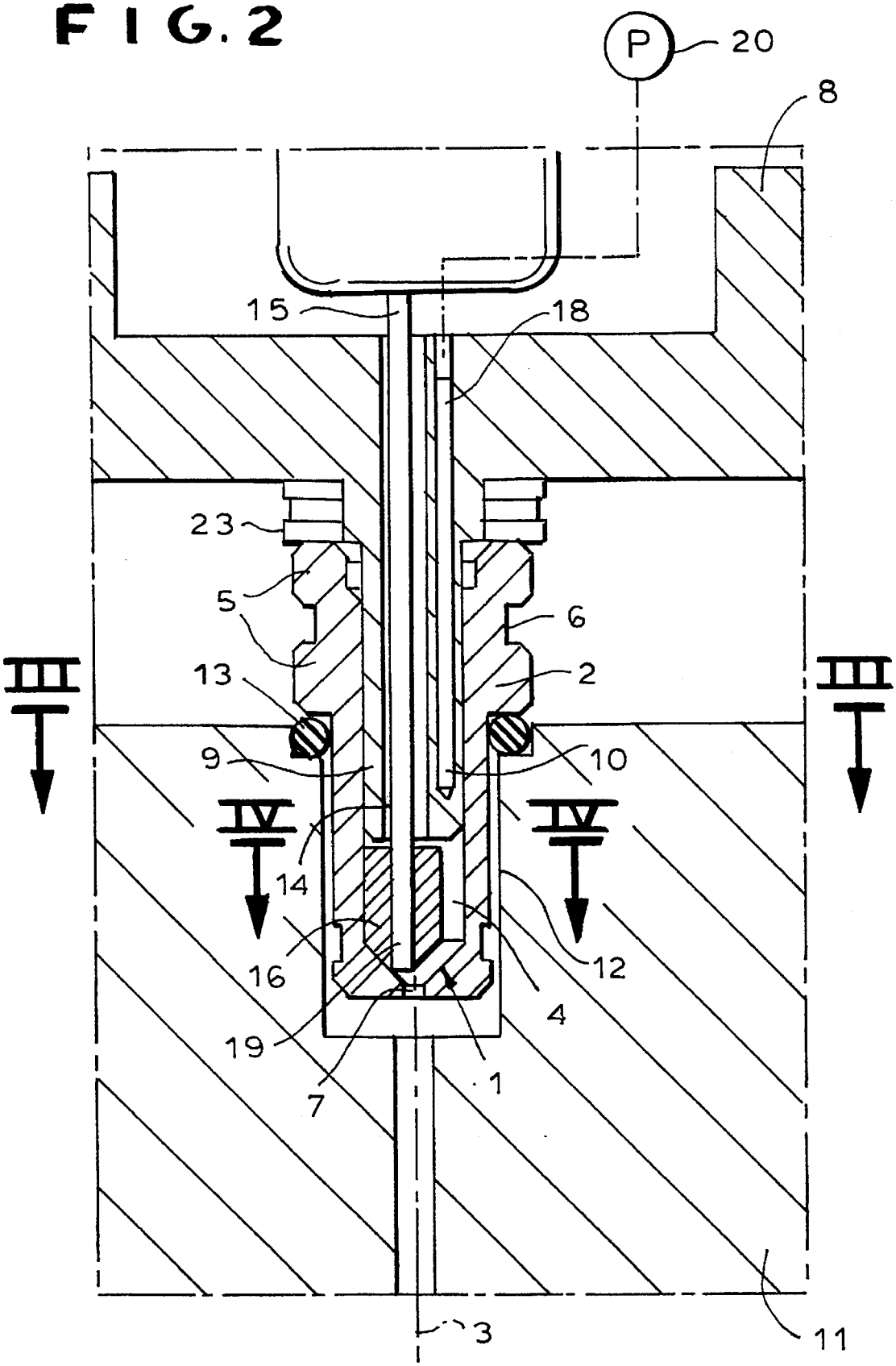
FIG. 2 is a detail thereof.

The driver 11 and the tool 16 are rotated in opposite rotational senses. As can be seen especially from FIGS. 2 through 5, the passage 14 can have a greater diameter than the shaft 15 so that binding of the latter is avoided. The hydraulic centering medium can also be introduced into bore 14 so that the shaft 15 can be centered therein. The bore 14 can surround the geometric axis of the mandrel 9 concentrically (see FIG. 2). When an oscillatory movement is superimposed on the shaft 15 this movement can be in the axial direction as well as the inclined direction which is preferred.

I claim:

1. An apparatus for precision grinding of an internal conical sealing surface of a nozzle workpiece adjacent a cylindrical bore coaxial with the sealing surface and having an orifice coaxial with the sealing surface at an apex thereof, said apparatus comprising:

a machine slide;

a hydrocentric mandrel mounted on said machine slide and upon which said workpiece is positioned and having an outer surface juxtaposed with a wall of said bore, and outlet openings at said outer surface spaced along a length of said mandrel for forcing a centering liquid between said mandrel and said workpiece, said mandrel having a central passage;

a driver body movable toward said machine slide and formed with a cylindrical recess receiving said workpiece and provided with means for rotating said body about an axis of said recess;

an elastic entrainer on said body frictionally engageable with said workpiece upon movement of said driver body toward said machine slide for rotatably entraining said workpiece with said body around said axis;

a precision grinding tool located beyond an end of said mandrel engaging said internal conical sealing surface;

a drive shaft connected to said tool and extending through said passage; and a motor on said slide connected to said shaft for driving said tool.

2. The apparatus defined in claim 1 wherein said mandrel is provided with axially extending distributor bores spaced around said axis and provide with said outlet openings for introducing said centering liquid between said mandrel and said workpiece.

3. The apparatus defined in claim 1 wherein said means for rotating said body and said motor rotate said tool and said body in opposite rotational senses.

4. The apparatus defined in claim 1 wherein said elastic entrainer is an elastic ring.

5. The apparatus defined in claim 4 wherein said ring is a rubber ring.

6. The apparatus defined in claim 5 wherein said ring is an O-ring.

7. The apparatus defined in claim 1 wherein said passage has a larger diameter than said drive shaft.

8. The apparatus defined in claim 1 wherein said shaft is eccentric to said axis.

9. The apparatus defined in claim 1 wherein said passage eccentrically surrounds the geometric axis of said mandrel.

10. The apparatus defined in claim 1 further comprising means for superimposing an oscillation upon the rotation of said drive shaft.

11. The apparatus defined in claim 10 wherein said means for superimposing said oscillation includes means for shifting said drive shaft in a direction parallel to a generatrix of said internal conical sealing surface.

12. The apparatus defined in claim 11 wherein said mandrel is provided with axially extending distributor bores spaced around said axis and provide with said outlet openings for introducing said centering liquid between said mandrel and said workpiece.

13. The apparatus defined in claim 12 wherein said means for rotating said body and said motor rotate said tool and said body in opposite rotational senses.

14. The apparatus defined in claim 13 wherein said elastic entrainer is an elastic ring.

15. The apparatus defined in claim 14 wherein said ring is a rubber ring.

16. The apparatus defined in claim 15 wherein said ring is an O-ring.

17. The apparatus defined in claim 16 wherein said passage has a larger diameter than said drive shaft.

18. The apparatus defined in claim 17 wherein said shaft is eccentric to said axis.

* * * * *